US007213348B2

(12) United States Patent
Ackermann et al.

(10) Patent No.: US 7,213,348 B2
(45) Date of Patent: May 8, 2007

(54) GAS BURNER AND AIR HEATER ASSEMBLY FOR A GAS CLOTHES DRYER

(75) Inventors: Uwe Ackermann, Schönwalde (DE); Brian Chatot, New Bern, NC (US); Travis Dardeau, New Bern, NC (US); Dirk Gauger, Berlin (DE); John Pendleton, Trent Woods, NC (US); Patrick Schueler, New Bern, NC (US); Guenter Steffens, Seeburg (DE)

(73) Assignee: BSH Home Appliances Corporation, Huntington Beach, CA (US)

( * ) Notice: Subject to any disclaimer, the term of this patent is extended or adjusted under 35 U.S.C. 154(b) by 44 days.

(21) Appl. No.: 10/987,601

(22) Filed: Nov. 12, 2004

(65) Prior Publication Data

US 2006/0101662 A1 May 18, 2006

(51) Int. Cl.
*F26B 19/00* (2006.01)

(52) U.S. Cl. ..... 34/86; 34/601; 431/351

(58) Field of Classification Search ..... 34/86, 34/601, 602, 603; 432/105; 431/351; 126/91 A
See application file for complete search history.

(56) References Cited

U.S. PATENT DOCUMENTS

| | | | | |
|---|---|---|---|---|
| 1,908,135 A | | 5/1933 | Forster | |
| 2,061,561 A | | 11/1936 | Cartter | |
| 2,531,316 A | * | 11/1950 | Zink | 431/284 |
| 2,840,152 A | * | 6/1958 | Reed | 431/349 |
| 2,857,204 A | * | 10/1958 | Gross | 239/543 |
| 3,439,997 A | | 4/1969 | Hancock et al. | |
| 3,630,649 A | | 12/1971 | Hancock et al. | |
| 3,850,571 A | | 11/1974 | Zink | |
| 3,859,036 A | | 1/1975 | Schantz | |
| 4,604,048 A | | 8/1986 | Schwartz | |
| 5,738,508 A | * | 4/1998 | Dobbeling et al. | 431/350 |
| 6,106,276 A | | 8/2000 | Sams et al. | |
| 6,918,194 B2 | * | 7/2005 | Freese et al. | 34/604 |

FOREIGN PATENT DOCUMENTS

EP 0 210 313 A1 2/1987

* cited by examiner

*Primary Examiner*—S. Gravini
(74) *Attorney, Agent, or Firm*—Russell W. Warnock; Craig J. Loest

(57) ABSTRACT

A burner for a gas dryer is made up of a mixing tube having an open end for admission of gas fuel into the mixing tube. At least one other opening proximate to the open end serves to admit air into the mixing tube for mixing the air and the gas fuel. A burner head is located at an end of the mixing tube opposite the open end for allowing a mix of gas fuel and air to be discharged and be ignited into a flame. A baffle is attached to the burner at the base of the burner head and extends radially outward therefrom to prevent disruption of combustion of the gas fuel and air mixture as a result of secondary air being drawn outside and along the length of the mixing tube from the open end thereof toward the burner head. An air heater assembly for gas dryer includes combustion chamber having an air inlet and an air outlet for allowing air to flow therethrough and be heated for being passed over clothes to be dried in a drum of a dryer. The aforementioned burner is employed in the air heater assembly within the combustion chamber.

10 Claims, 6 Drawing Sheets

GAS BURNER AND AIR HEATER ASSEMBLY FOR A GAS CLOTHES DRYER

BACKGROUND OF THE INVENTION

1. Field of the Invention

The present invention relates to a gas burner for a gas dryer which produces an even and well dispersed flame distribution, with low consumption of fuel and reduced noxious emissions such as carbon monoxide. In another aspect, the present invention relates to a heater assembly for a gas clothes dryer which employs such a burner.

2. Discussion of the Prior Art

Gas burners are used in a number of applications ranging from furnaces, gas clothes dryers and other like applications in which it is desired to heat air for use for various purposes. A universal requirement for all burners is that they should be efficient in burning fuel supplied, generally are required to provide a desired flame profile depending on the application, should be quiet and should not produce large amounts of potentially harmful bi-products such as carbon monoxide.

In the case of the use of such burners in household applications, one current prominent use is in clothes dryers, typically clothes dryers using natural gas as a fuel. Such dryers can be a popular amenity for households of all incomes since consumers can dry two loads of clothes in a natural gas dryer, on average, for the amount of money it costs to dry just one load in an electric dryer.

For additional savings and energy conservation, current natural gas dryers use electronic ignition systems instead of a continuously burning pilot light. Generally such dryers work by moving warm air through the clothes inside. Inside of the dryer is a rotating drum and the dry heated air created by a natural gas burner flows over and through the clothes as the drum tosses them through the air. The moist air coming off the clothes is exhausted through a vent to the outdoors, and is replaced by more dry heated air.

Due to current energy costs, it is very important that burners employed in heaters in natural gas dryers function with high efficiency while providing a wide flame distribution to heat a maximum amount of air. This provides a large flow of warm air to clothes being dried. It is also important that such burners avoid producing harmful or noxious byproducts such as carbon monoxide, due to the fact that even though gas dryers are vented generally to the outside, they are still used in enclosed home, and typically within smaller rooms such as laundry rooms. If such bi-products are produced at any high level, there is a high risk of harm to occupants or pets of the homes, and in particular, to operators of the gas clothes dryer.

In the past design of burners, it has been recognized that unintended secondary airflow around the burner head or nozzle of a burner can result in imperfect burning of fuel with resultant undesirable by-products. One prior art burner recognizes that the burning of fuels can result in the formation of nitrogen oxides ($NO_2$), which when released to the atmosphere constitute pollutants.

In order to avoid such bi-products, one approach involves providing a fuel discharge nozzle with a shielding cone, which is generally disk shaped and includes a plurality of openings formed therein for allowing passage of a limited amount of air therethrough. The cone is an attempt to create a protected area adjacent the nozzle. However, as a result of the air flowing through openings in the cone, there still results an incomplete burning of fuels with resultant undesirable bi-products. Moreover, there is also caused a redirection of the flame in the direction of the secondary air being passed through the openings in the cone.

Another attempt to influence fuel burning with a burner involves an arrangement, which produces flames as long, slender rod like jets of great length. In this burner arrangement, one or more principal orifices are placed symmetrically on or about the axis of a pipe. The principal flow of gas is through these principal orifices. Secondary jets issue from the pipe at an angle to the axis of the pipe. The secondary orifices are shielded by a baffle surrounding the orifices which also includes openings for inducing air into the space adjacent to the secondary orifices, thereby also affecting the direction of the flame and the burning efficiency.

In yet still another arrangement, a conical shroud is provided shaped to avoid lateral divergence of flames. Such an arrangement results in an essentially unidirectional flame, which is not well suited for heating large volumes of air.

In accordance with the present invention, the problems of the prior art are avoided by providing a burner for use, in particular, with a gas clothes dryer, which functions efficiently in terms of consumption of fuel, produces a substantially constant flame with low levels of undesirable bi-product emissions, is not subject to adverse effects on the flame resulting from secondary air flow, and provides a flame which is dispersed over a wide area to provide heating of large volumes of air for use in a dryer.

BRIEF SUMMARY OF THE INVENTION

In one aspect, there is disclosed a burner for providing a stable flame for heating air. The burner includes a mixing tube having an open end for admission of gas fuel thereunto and at least one opening proximate to the open end for admission of air thereunto to allow mixing of air and gas in the mixing tube. A burner head is located at an end of the mixing tube opposite the open end for allowing mixed gas and air to be discharged therethrough and ignited into a flame. The burner head is of substantially hemispheric shape and has a plurality of discharge openings formed by perforations and slots distributed along the surface thereof for providing a substantially uniform distribution of flames emanating from the surface thereof. A baffle is attached to the burner at the base of the burner head, and extends radially outward therefrom an amount sufficient to prevent disruption of combustion of the air gas fuel mixture being discharged from the burner head resulting from air being drawn along the length of the mixing tube on the outside thereof from the open end thereof toward the burner head.

In a more specific aspect, the burner head includes a region at substantially the apex thereof having no discharge openings on the surface.

In a yet more specific aspect, the plurality of discharge openings in the baffle are of a size, distribution and number effective to prevent lightback. Preferably, the discharge openings are sixteen discharge openings arranged in two concentric equally spaced arrangements of eight openings below the region of the burner head, which has no openings. This results in a generally wide flame distribution substantially radially out from the burner head.

In an alternative aspect, the present invention relates to an air heater assembly for a gas dryer which includes a combustion chamber having an air inlet and an air outlet for allowing air to flow therethrough, for being heated and for being passed to clothes to be dried in a drum of the dryer. The air heater assembly includes, among other components, the afore-described burner for providing a stable flame for heating the air being passed through the combustion chamber.

BRIEF DESCRIPTION OF THE SEVERAL VIEWS OF THE DRAWING

Having thus generally described the present invention, the same will become better understood from the following detailed discussion, made with reference to the appended drawing wherein.

DETAILED DISCUSSION OF THE INVENTION

Figure 1:
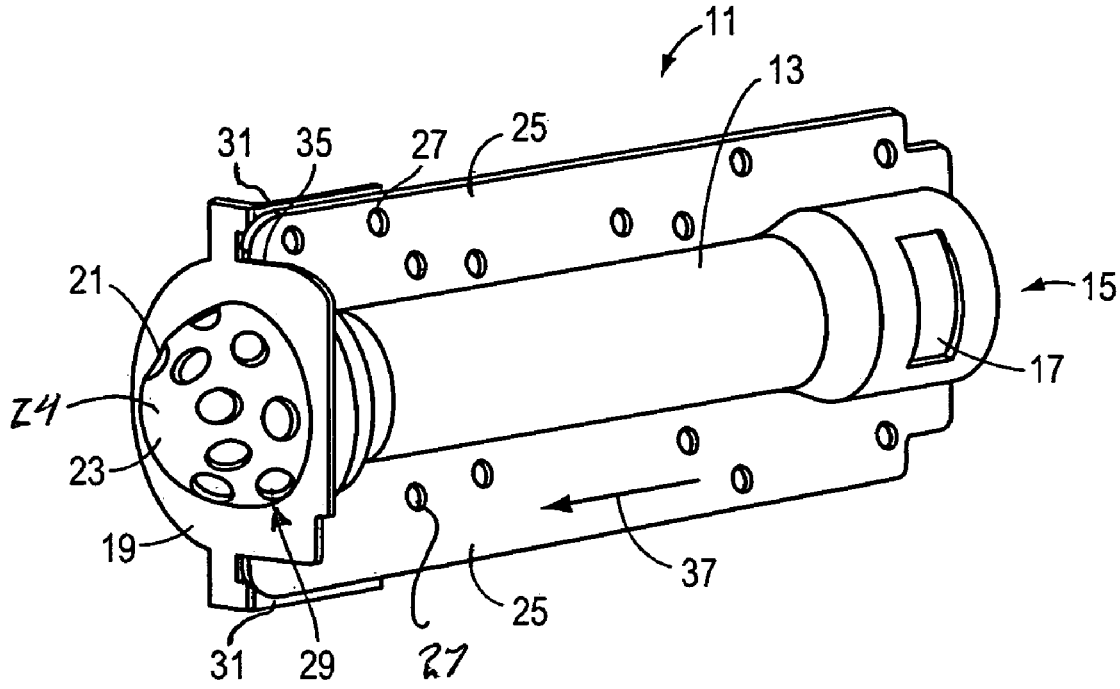
FIG. 1 is a perspective view of the burner in accordance with the present invention viewed from one side thereof.
Figure 2:
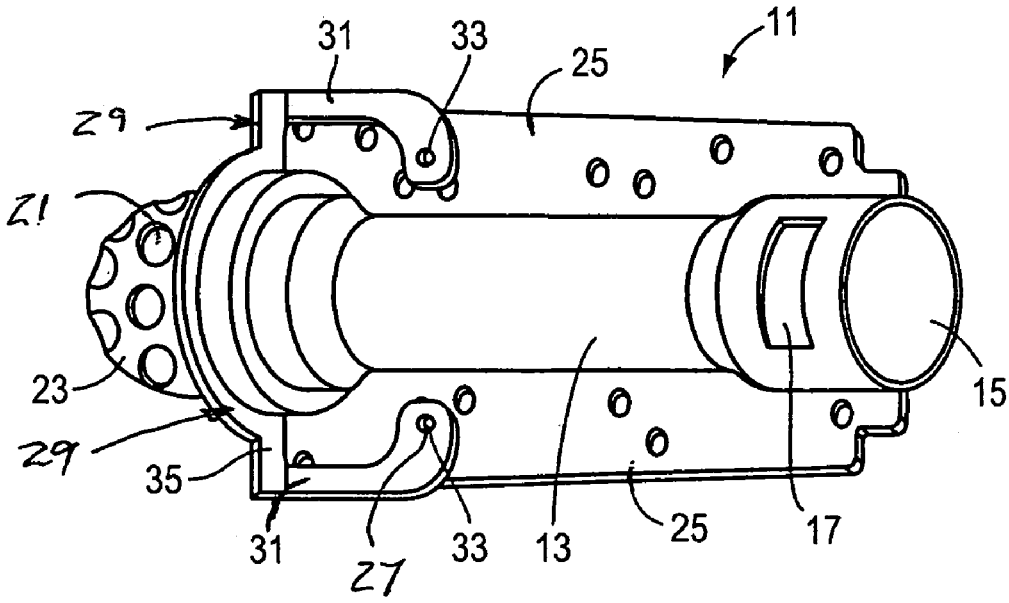
FIG. 2 is a perspective view of the burner of FIG. 1 viewed from the other side thereof.

FIGS. 1 and 2 illustrate the burner 11 in accordance with the present invention. The burner 11 includes a mixing tube 13 for mixing fuel such as natural gas or propane with air. The mixing tube 13 includes a gas fuel inlet opening 15. There is also an air inlet opening 17 for having air and gas fuel entrained into the mixing tube 13 and mixed therein. The burner 11 includes a gas burner head 19 having a plurality of perforations or openings 21 therein for discharging a fuel air mixture from the mixing tube 13 and out the burner head 19. The gas burner head 19 includes a closed region 23 at the apex 24 thereof such that the air fuel mixture discharged therefrom, and resulting flames radiate generally radially outward from the gas burner head 19.

In order to avoid the resulting flames from being disrupted and thus, result in generation of undesirable by-products such as carbon monoxide, etc., a baffle 29 is provided which includes a pair of attachment members 31 as extensions from the baffle 29, extending generally in a direction parallel to the mixing tube 13. The baffle 29 includes an air deflection plate 35 to prevent air which is entrained on the outside of the burner 11 in the direction of an arrow 37 from disrupting combustion of the fuel air mixture being discharged through the perforations or openings 21.

Figure 3:
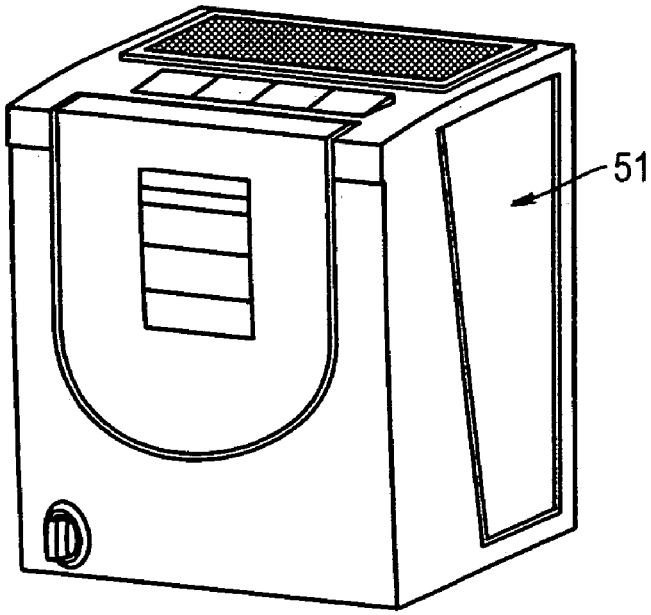
FIG. 3 is a perspective view of a gas dryer in which the burner in accordance with the invention may be employed.

The burner 11 also includes a pair of top and bottom plates 25 having a plurality of perforations or openings 27 to facilitate the burner 11 being secured within a gas dryer 51 such as that shown in FIG. 3, for example, through the use of screws, bolts, or other conventional fasteners, etc.

Figure 4:
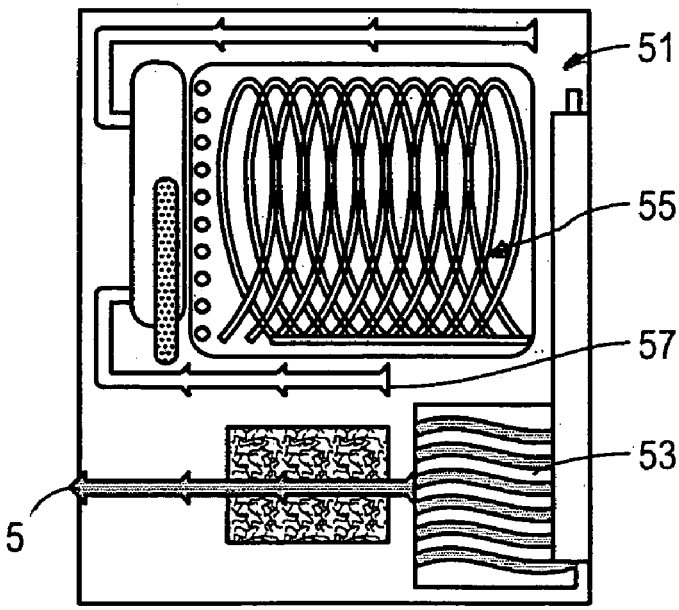
FIG. 4 is a schematic part cross sectional side view of a gas dryer, illustrating generally a heater which includes a combustion chamber, and is of the type employing the burner in accordance with the invention.
Figure 6:
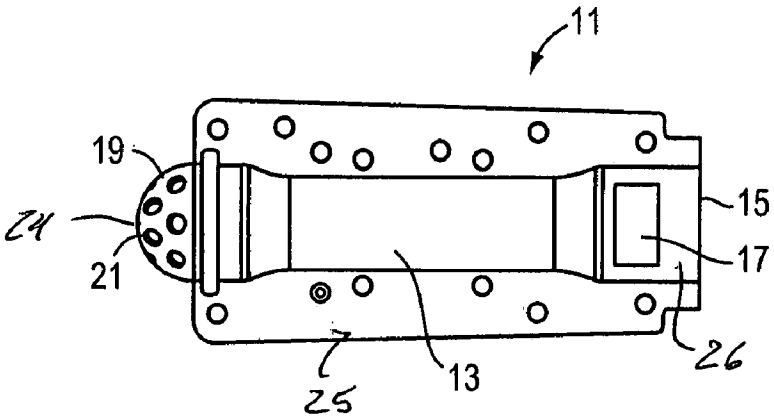
FIG. 6 is a view as in FIG. 5 from the other side thereof.
Figure 8:
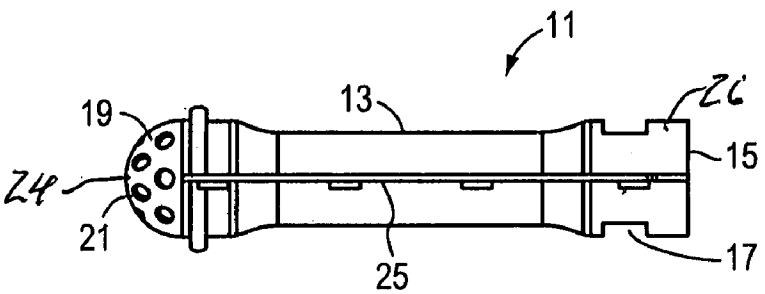
FIG. 8 is a top view of the burner in accordance with the burner shown without the baffle.
Figure 5:
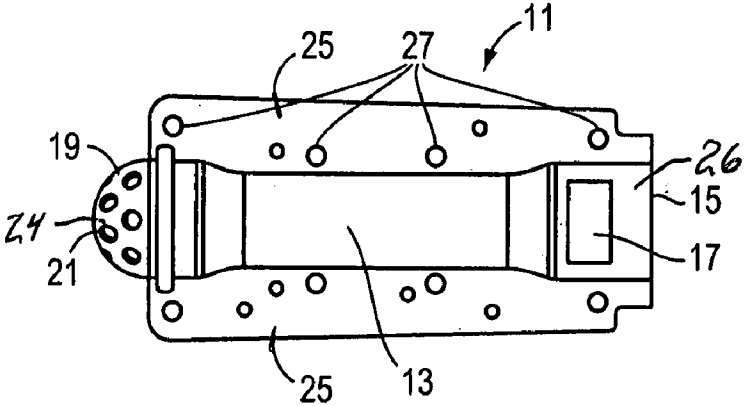
FIG. 5 is a side view of the burner in accordance with the present invention shown without the baffle.
Figure 7:
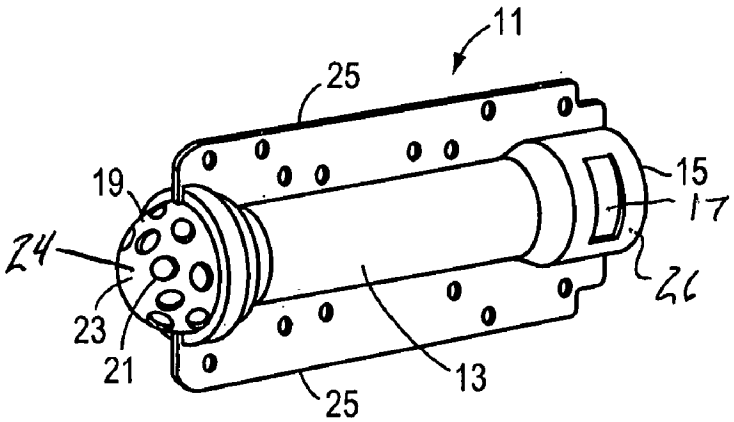
FIG. 7 is a perspective view of the burner in accordance with the invention shown without a baffle.
Figure 9:
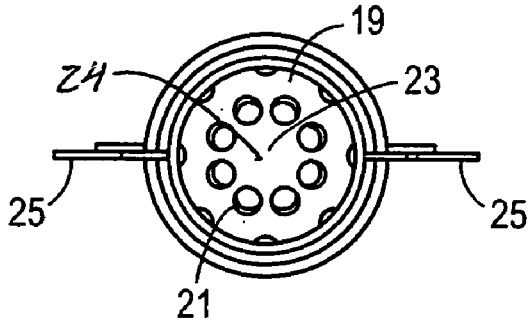
FIG. 9 is a plan view from the end showing the burner head of the burner in accordance with the present invention.

The gas dryer 51, also illustrated in FIG. 4, typically includes a tumbler 55 inside for receiving wet clothes therein be tumbled and dried by rotation of the tumbler 55. The air dryer includes a heater 53 which houses the burner 11 which is secured in a fixed position within the heater 53 with a combustion chamber through engagement with plates 25, and attached through perforations 27 with appropriate screws, bolts, or other conventional fasteners, etc. The baffle 29 also is secured to the plates 25 by a pair of members 31, each having an opening 33, which openings 33 are aligned with the corresponding openings 27 of the plates 25.

Figure 10:
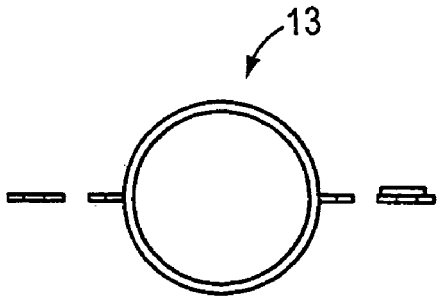
FIG. 10 is a partial cross-sectional view of the mixing tube shown from the end proximate to the burner head.
Figure 11:
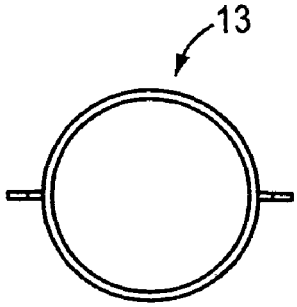
FIG. 11 is a partial cross sectional view of the mixing tube from the end proximate to the fuel inlet.
Figure 12:
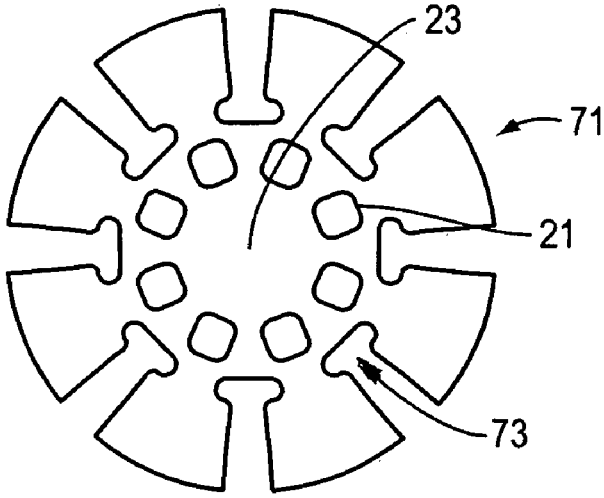
FIG. 12 is a top plan view of a stamping used to construct the burner head of the invention.
Figure 13:
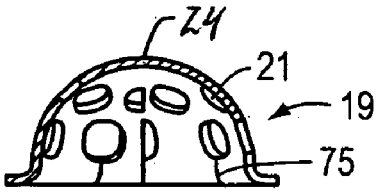
FIG. 13 is a side cross sectional view of the burner head.
Figure 14:
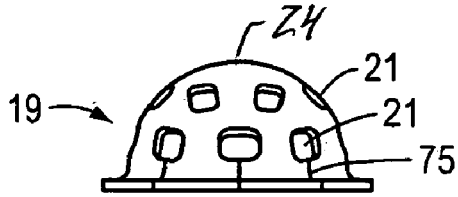
FIG. 14 is a side view of the burner head.
Figure 15:
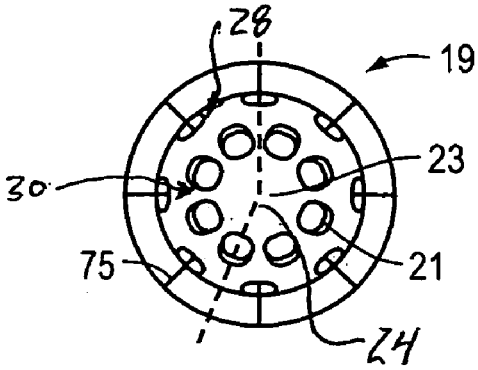
FIG. 15 is a top plan view of the burner head.
Figure 16:
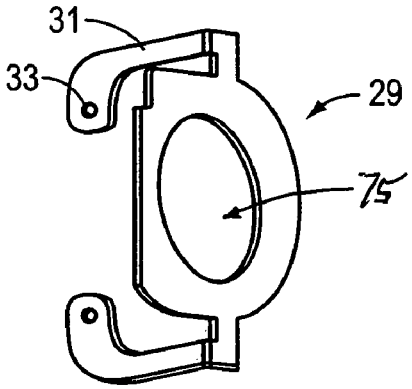
FIG. 16 is a perspective view from one side of the baffle employed with the burner.
Figure 17:
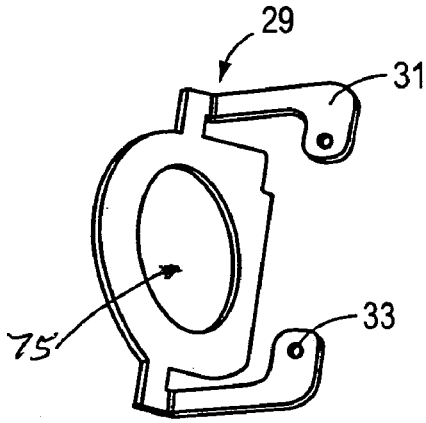
FIG. 17 is a perspective view from the other side of the baffle.
Figure 18:
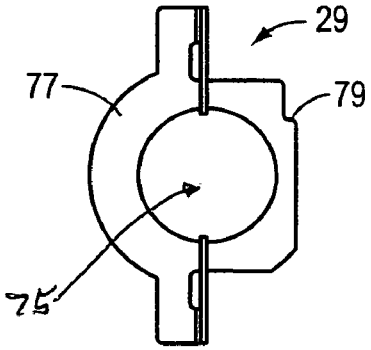
FIG. 18 is a plan view of the baffle from one side.
Figure 19:
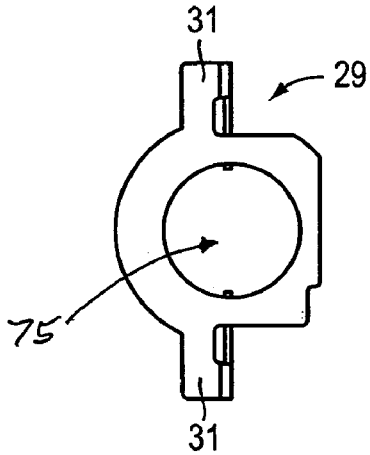
FIG. 19 is plan view of the baffle from the other side.
Figure 20:
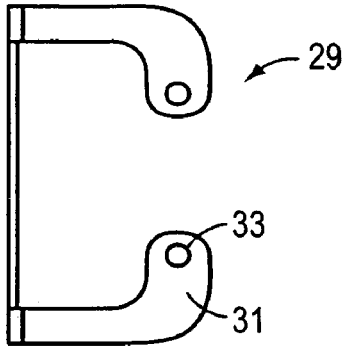
FIG. 20 is a side view of the baffle.

The burner 11 is shown in greater detail in FIGS. 5–8, shown without the baffle 29 attached. As may be appreciated from FIGS. 5–8, the mixing tube 13 is of a generally smaller diameter than the burner head 19. The smaller diameter mixing tube 13 allows for the discharge of the fuel air mixture to expand outwardly and out radially generally through the perforations 21 to result in a widely dispersed flame pattern (not illustrated). However, as also shown in FIGS. 5–8 and 11, the mixing tube 25 also includes a slightly larger open portion at the fuel inlet end thereof to allow appropriate volumes of fuel and air to enter through the inlet opening 15 and the air inlet 17 into a smaller cross section of the mixing tube 13 extending to the end proximate to the burner head 19 as is shown in FIG. 10. As shown in FIG. 9, and FIGS. 12–15, the burner head 19 is made from a stamped plate 71, which includes the perforations 21 as well as a plurality of slots 73. When forced into shape to form the burner head 19, the slots 73 close to result in joined regions 75 and additional perforations 21. The perforations 21 preferably are arranged in two substantially concentric circles 28 and 30 of eight perforations 21, with the region 23 of the burner head 19 being closed to form the apex 24. The burner head 19 so formed causes the fuel air mixture to be discharged generally radially resulting in a wide flame pattern (not illustrated) thereby maximizing the amount of air heated and passed into the tumbler region 55 of the dryer 51.

As further shown in FIG. 4, when the air is heated by the heater 53, it passes through a path 57 into the tumbler 55 and therefrom after drying clothes therein by removing moisture, and it is discharged through a discharge path 59.

The baffle 29 in accordance with the present invention is more clearly shown in FIGS. 16–20 and includes a rounded section 77 of the air deflection plate 35 and a more contoured section 79 of the air deflection plate 35 to accommodate space constraints and fitting within the dryer 53. As may be appreciated, the air deflection plate 35 can take on various other shapes as necessary to the environment in which it is employed. What is important is that the size relative to fuel flow is an amount sufficient to eliminate the effects of secondary air flow such as that shown by arrow 37 in FIG. 1.

It is important to appreciate that a central opening 75 of the baffle 29 through which the burner head 19 passes needs to be of a very precise size to ensure no air leakage between the opening 75 at the region where the baffle 29 seats against a base of the burner head 19. The members 31 extend along the same direction as the mixing tube 13 and are secured to the plates 25 through the openings or perforations 33. The burner 11, and in particular the gas burner head 19 is preferably made of stainless steel, such as 304 or 430 stainless steel.

The burner 11 of the present invention can operate with alternative sources of fuel such as propane or natural gas. The size of the perforations 21 on the burner head 19 are selected to provide appropriate size flames to meet the requirements for heating air passed through a gas dryer 51. The location of the perforations 21 in the two concentric circles 28 and 30 and the sizes of the perforations 21 are selected such that when operated in combination with the baffle 29, results in no flashback yet has a smooth ignition, for example, with an electronic igniter. In selecting the sizes of the various components, they are optimized to result in carbon monoxide generation of less than 0.04% (400ppm), in an air-free sample of the flue gases from the dryer.

Having thus generally described the invention in detail, the same will become better understood from the appended claims in which it is described in a non-limiting manner.

What is claimed is:

1. An air heater assembly for a gas dryer, comprising:

a combustion chamber having an air inlet and an air outlet for allowing air to flow therethrough for being heated to be passed to clothes to be dried in a drum of the dryer; and a burner for providing a stable flame for heating said air being passed through said combustion chamber, said burner comprising:

a mixing tube having an open end for admission of gas fuel thereunto and at least one opening proximate to said open end for admission of air thereunto to allow mixing of air and gas fuel in the mixing tube;

a burner head at an end of the mixing tube opposite said open end for allowing mixed gas fuel and air to be discharged therethrough and ignited into a flame, said burner head being of substantially hemispheric shape and having a plurality of discharge openings distributed along the surface thereof for providing a substantially uniform distribution of flames emanating from the surface thereof; and a baffle attached to the burner at the base of the burner head and extending radially outward therefrom an amount sufficient to prevent disruption of combustion of the air gas fuel mixture being discharged from the burner head as a result of secondary air being drawn outside along the length of the mixing tube from the open end thereof toward the burner head.

2. The air heater assembly of claim 1, wherein said burner head further comprises a region at substantially the apex of the substantially hemispherical surface having no discharge openings on the surface thereof.

3. The air heater assembly of claim 1, further comprising at least one plate extending outward along the length of the mixing tube for securing the burner within a heating unit of an appliance.

4. The air heater assembly of claim 3, wherein said at least one plate comprises two plates, each one extending from said mixing tube at a location on said mixing table opposite from the other plate.

5. The air heater assembly of claim 1, wherein the plurality of discharge openings and the baffle are of a size, distribution and number effective to prevent lightback.

6. The air heater assembly of claim 1, wherein said discharge openings comprise sixteen discharge openings arranged in two concentric equally spaced arrangement of eight openings.

7. The air heater assembly of claim 2, wherein said discharge openings comprise sixteen discharge openings arranged in two concentric equally spaced arrangements of eight openings in substantially circular distribution below said apex which has no discharge openings on the surface thereof.

8. The air heater assembly of claim 1, wherein said baffle is separate from said mixing tube and includes at least one member for being attached to the mixing tube.

9. The air heater assembly of claim 4, wherein said baffle is separate from said mixing tube and includes two members, each one for attaching the baffle to the mixing tube by connecting a respective member to a respective plate of said mixing tube.

10. The air heater assembly of claim 1 wherein the burner head is greater in diameter than said mixing tube to ensure a substantially radial distribution of flame from the surface thereof for maximizing the amount of air heated.

* * * * *